US005110267A

United States Patent [19]

Giordani

[11] Patent Number: 5,110,267

[45] Date of Patent: May 5, 1992

[54] POSITIVE-DISPLACEMENT PUMP FOR PUMPING ALIMENTARY LIQUIDS

[76] Inventor: Alberto Giordani, Via IV Novembre, 13 Montebello Vic.No (Vicenza), Italy, 36054

[21] Appl. No.: 446,768

[22] Filed: Dec. 6, 1989

[30] Foreign Application Priority Data

Dec. 6, 1988 [IT] Italy ..... 22869 A/88

[51] Int. Cl.[5] ..... F04B 17/00

[52] U.S. Cl. ..... 417/404; 91/299; 92/31

[58] Field of Search ..... 417/404, 490, 528; 137/533.11, 533.13, 533.15; 251/364; 91/299; 92/31, 173

[56] References Cited

U.S. PATENT DOCUMENTS

| | | | |
|---|---|---|---|
| 1,173,326 | 2/1916 | Taylor | 92/31 |
| 3,099,016 | 7/1963 | Edwards | 137/513.13 |
| 3,234,746 | 2/1966 | Cope | 417/404 |
| 3,628,638 | 12/1971 | Currmack | 92/31 |
| 3,700,359 | 10/1972 | Vanderjagt | 117/528 |
| 3,775,028 | 11/1973 | Davis | 917/404 |
| 3,901,129 | 8/1975 | Butterworth | 91/299 |
| 4,209,285 | 6/1980 | Jasinski | 417/571 |

FOREIGN PATENT DOCUMENTS

| | | | |
|---|---|---|---|
| 1550530 | 9/1969 | Fed. Rep. of Germany | 137/535.15 |

*Primary Examiner*—Richard A. Bertsch
*Assistant Examiner*—Peter Korytnyk
*Attorney, Agent, or Firm*—Wenderoth, Lind & Ponack

[57] ABSTRACT

A reciprocating positive displacement pump is disclosed for pumping oenological liquids such as wines, musts, distillates, vinegars and the like, alimentary oils and other alimentary liquids and/or beverages such as fruit juices and pulpy and sugary juices. The pump is of the kind which has a reciprocating piston and distributing ball valves utilizing rubber-covered balls, and comprises a double-action hydraulic cylinder for actuating the piston, the hydraulic cylinder being fed by a central distribution unit which is in turn fed by a source of presurized fluid. The piston has a cam member mounted to its stem. The cam member is movable between contact with two limit switches upon reciprocation of the piston so as to cause direction reversal of the piston. Further, a rotating member can be provided in contact with the cam member, so as to rotate the cam member and thus, the piston stem and piston.

8 Claims, 2 Drawing Sheets

POSITIVE-DISPLACEMENT PUMP FOR PUMPING ALIMENTARY LIQUIDS

BACKGROUND OF THE INVENTION

1. Field of the Invention

The present invention relates to a reciprocating positive displacement pump particularly suitable for the pumping of oenological liquids such as wines, musts, distillates, vinegars and the like, of alimentary oils and of other alimentary liquids and/or beverages such as fruit juices and pulps, sugary juices, etc.

2. Prior Art

As is know, in order to pump oenological liquids and alimentary liquids in general by means of reciprocating piston type positive displacement pumps it is necessary that the liquids undergo the least possible agitation during the pumping operations in order to preserve their organoleptic characteristics, which would in fact be altered and/or comprised by the agitation and the forming of emulsions with air which always occur during turbulent motion.

In order to reduce the conditions of turbulence of oenological and alimentary liquids during their decanting from one container to another, the food industry employs single- or two-cylinder positive-displacement piston pumps, the actuation stem of which is reciprocatingly actuated by a connecting-rod/crank system. In particular, the positive displacement pumps used are normally of the single- or two-cylinder kind with distribution provided by ball valves made of rubber with metallic central cores. In these cases the length of the stroke of the piston is equal to the diameter of the circle traced by the small end of the connecting rod.

The reciprocating actuation system with connecting rod and crank has in practice various disadvantages and operative limitations.

The actuation system in fact provides a liquid flow which is pulsating rather than constant due to the fact that the speed of the piston (and therefore of the liquid) varies for each stroke of the piston from a zero value when the piston is at one end of the cylinder to a maximum value at mid-stroke and then back to the zero value at the end of the stroke. The change in the flow-rate of the liquid and therefore in the speed thereof entails considerable turbulence of the liquid which results in high stresses on the delivery pipes and a water hammer effect, as well as possible wear and/or breakage of the pipes. The disadvantage is worsened by the fact that in oenological plants the pipes are normally made of flexible material and are generally not coupled to fixed supports. Assuming constant piston diameter and speed, the liquid flow-rate is dependent on the maximum length of the piston's stroke which, in practice, is defined by the diameter of the circle defined by the connecting rod's small end, which depends on the diameter of the flywheel used to actuate the piston's system.

Since it is not convenient to use pistons and flywheels having diameters greater than certain limits due to pump cost and ease-of-handling reasons, in practice the maximum obtainable flow-rates are relatively modest.

SUMMARY OF THE INVENTION

The aim of the present invention is to overcome the above described disadvantages by providing the oenological industry and the industry of alimentary liquids in general, including dense liquids, with a two-stage positive displacement pump structured and actuated so as to create pumping with increased and constant flow rates without increasing the diameter of the pump's piston, and with a smaller number of piston stroke reversals and therefore a smaller number of speed changes with respect to what is provided by the known art, so as to advantageously result in less vibration.

An object of the invention is to provide a pump of the above specified type which is dimensioned so as to allow much higher pump filling coefficients than those obtainable with known positive-displacement pumps and to allow a reduced wear of the inflow and delivery ball valves, thus significantly reducing the noise produced by the system.

A further object of the invention is to provide a positive displacement pump which allows the flow rate to be varied in a simple and rapid manner, without varying the piston's speed, and for which scoring or damage of the internal walls of the pump's cylinder is prevented even when solid foreign matter is present between the cylinder walls and the piston's sealing gaskets.

Another object is to provide a pump which can be used and installed in any environmental condition, including immersion in a liquid.

A further object is to provide a decanting pump for the above specified applications which is structured and dimensioned so that it can be easily installed, together with the piston actuation devices, on a towable or self-propelled trolley to facilitate its movement.

This aim, these objects and others which will become apparent from the following description are achieved by a two-stage positive-displacement pump with a reciprocatingly slidable piston and with ball-valve distribution, particularly for pumping oenological liquids and alimentary liquids in general, including dense liquids, according to the accompanying claims.

BRIEF DESCRIPTION OF THE DRAWINGS

Further structural and functional characteristics of the pump according to the invention will become apparent from the following detailed description, given with reference to the accompanying drawings, which are provided merely by way of non-limitative example, wherein.

DETAILED DESCRIPTION OF THE PREFERRED EMBODIMENT

Figure 1:
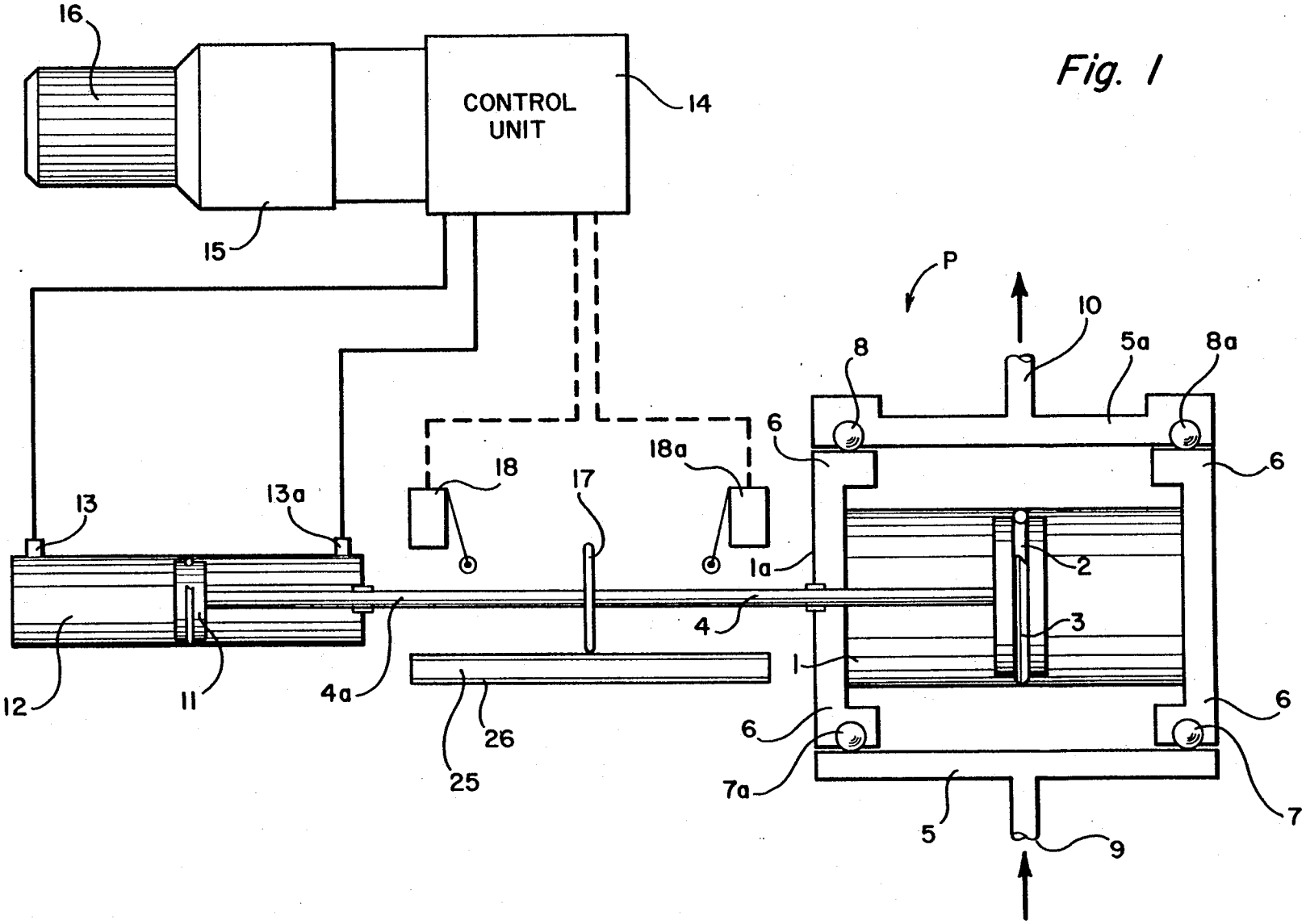
FIG. 1 is a schematic view of a two-stage positive displacement pump according to the invention.

With reference to the above described figures, and in particular to FIG. 1, a decanting pump P according to the invention comprises a hydraulic cylinder 1 made of stainless steel, inside which a piston 2 sealingly slides and is peripherally provided with an appropriate gasket 3.

The piston 2 has a stem 4 which extends through a front wall 1*a* and is sealingly slidable therethrough.

The hydraulic cylinder 1 is fluidically connected into a fluid network. Specifically, the hydraulic cylinder 1 is connected, at its opposite ends, to two longitudinal ducts 5, 5*a* through passages 6 in which conventional ball valves 7, 7*a* and 8, 8*a* made of rubber surrounding metallic cores are arranged. The valves 7, 7*a* constitute inlet valves which are operable to allow fluid to flow from the longitudinal inlet duct 5 into the passage 6. The valves 8, 8*a* constitute delivery valves which are operable to allow fluid to flow from the passages 6 into the longitudinal outlet duct 5*a*. The longitudinal inlet duct 5 is connected, by means of a tube 9, to the container of the liquid to be decanted, whereas the longitudinal outlet duct 5*a* is connected to a tube 10 for delivering the pumped liquid to a decanting container.

The stem 4 of the pump's piston 2 is coaxially and rigidly connected with the stem 4*a* of another piston 11 which is mounted sealingly and slidably within a hydraulic cylinder 12 and is reciprocable in both directions by pressurized fluid, such as oil, which is alternately fed through ports 13, 13*a*, by a conventional hydraulic control unit 14. The control unit 14 is provided with an oil tank and with a related conventional oil-air or oil-water heat exchanger.

The pressurized oil is fed to the control unit 14 by a variable flow rate positive displacement pump 15 actuated by an electric motor 16 (or by an internal-combustion engine). According to a first embodiment, the alternating reversal of the flow of pressurized oil in the hydraulic cylinder 12 is performed by the control unit 14 upon an actuation imparted by a cam-like element 17 or the like which is rigidly connected to the stem 4, such that as the stem 4 is reciprocated, the cam 17 is moved back and forth and alternately makes contact with two limit switches 18, 18*a*. The limit switches 18, 18*a* are constituted by position sensors associated with hydraulic, electric or other known shunting valves which, upon every impact with the cam 17, transmit a signal to the control unit 14, which reverses the hydraulic flow to the cylinder 12.

According to another embodiment, the alternated reversal of the pump's piston can be provided by means of a distributing valve which can deflect the flow in the hydraulic cylinder 12 every time a maximum preset pressure is reached in the pump. With this system, the movement of the pump's piston can reverse during the stroke if there is any foreign matter in the cylinder.

In practical use, the assembly formed by the positive displacement pump 1, the hydraulic cylinder 12, the associated limit switches 18, 18*a*, the control unit 14 and the positive displacement pump 15 with associated motor 16 can be easily mounted on a towable or self-propelled trailer in order to facilitate its movement among various areas of utilization.

If a plurality of pumps is mounted in battery, it is necessary to install the limit switches 18, 18*a* on the pump in order to adjust the offset of the deliveries.

Figure 2:
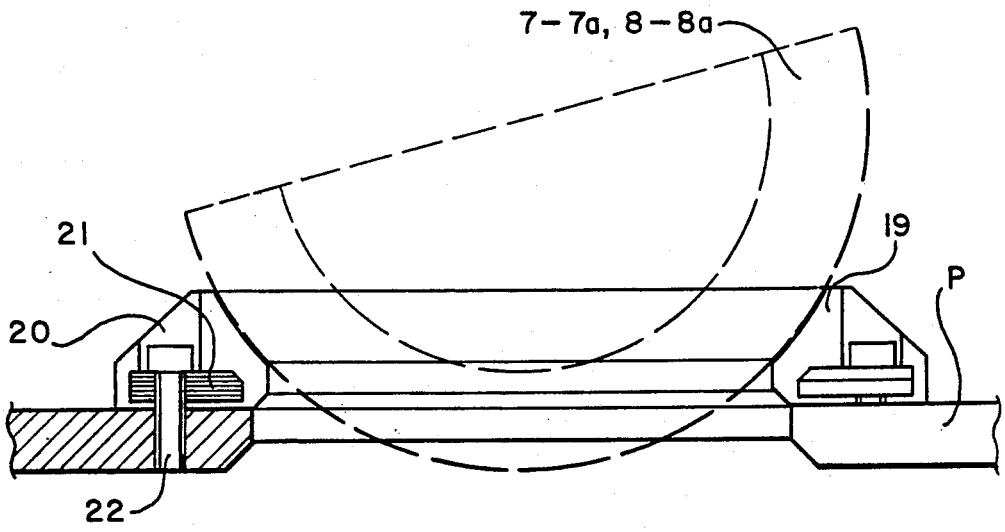
FIG. 2 is a sectional view of a seat for a sealing valve, made of elastically resilient material, such as rubber or the like, and with a metallic core, to reduce the noise produced by the pump and extend the useful life of the seat.

According to the invention, in order to minimize the noise produced by the decanting pump 1 and extend the useful life of valve seats 19 of the valves 7, 7*a* and 8, 8*a*, the valve seats 19 (FIG. 2) are made of rubber with a metal core 20 and are provided with holes 21 for fixing them, by means of screws or the like 22, to the body of the pump P. By means of this solution, the possible presence of foreign solid matter, such as for example the matter found in grape crushes, cannot cause damage to the valve seats, whereas if said seats were made of steel they would be subjected to scoring or incisions which would compromise the seal of the valves.

The operation of the above described two-stage positive displacement pump is conventional. That is, it operates as a double-action pump with intake and discharge cycles performed by the piston 2 which, during a leftward stroke (as viewed in FIG. 1), sucks the liquid in through the inlet valve 7, while the opposite inlet valve 7*a* remains pressed in its seat so that the liquid present in the portion of the cylinder 1 to the left (as viewed in FIG. 1) of the piston 2 is compressed and forced through the delivery valve 8*a* to the longitudinal delivery duct 5*a*. In the reverse (rightward) stroke, the liquid is sucked in through the inlet valve 7*a* while the inlet valve 7 is forced to remain closed such that the liquid contained in the part of the cylinder 1 to the right (as viewed in FIG. 1) of the piston 2 is compressed and forced through the delivery valve 8 and into the longitudinal delivery duct 5*a*.

Analyzing the operation of the pump, the piston 2 reciprocates in the hydraulic cylinder 1 with an equal stroke length in both directions such that the sliding of the piston 2 is as constant as possible and, therefore, incurs very short direction reversal times. The reversal of the direction of the piston movement is also facilitated by the small masses which are in motion and by the absence of a flywheel and of the associated prior art connecting-rod systems. In practice, the adoption of a hydraulic cylinder results in highly precise pumping cycles and speed even when the speed of the motor fluctuates or when the temperature of the oil of the hydraulic circuit varies.

Since the decanting pump cycles are shorter, the hydraulic cylinder of the decanting pump P can furthermore be made longer, for example 2.5 times longer or more, than the cylinder of current pumps actuated by crank systems. In this manner, a greater intake capacity and therefore a greater volumetric efficiency are achieved. With this solution, the number of stroke reversals of the piston 2 is smaller than for known pumps having equal flow-rates. Therefore, the ball valves 7, 7*a* and 8, 8*a* are worked less than in conventional systems and have a longer useful life.

The variation of the flow rate of the decanting pump P according to the invention is achieved by varying the number of cycles thereof, which is, of course, achieved by varying the flow rate of the hydraulic pump 15 of the hydraulic circuit. This can be accomplished by means of an adapted external regulator which can be positioned even remotely from the variable flow rate hydraulic pump 15.

A plurality of such regulators can be mounted in batteries, with no limitations in number, in order to control the flow rate in a programmable manner.

With such a system, it is in fact possible to "preset" a number of various flow rates, equal to the number of regulators, and to select from among the flow rates by means of, for example, a simple electric, hydraulic or similar "ON-OFF" signal.

By adopting a pump according to the present invention, it is therefore possible to achieve a flow rate which can vary from zero to a maximum value or can vary among a plurality of "freely presettable" flow rates.

If the limit switches 18, 18*a* are moved, for example, closer together or farther apart, in order to vary the flow rate, the speed of the piston remains constant, but the pump is less efficient.

Figure 3:
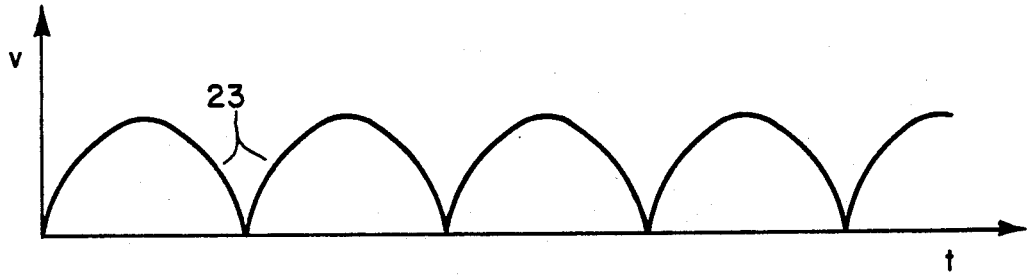
Fig. 3 PRIOR ART
FIG. 3 is a time diagram of the variations of the speed of the piston of a reciprocating double-action pump, actuated by means of known connecting-rod/crank systems.
Figure 4:
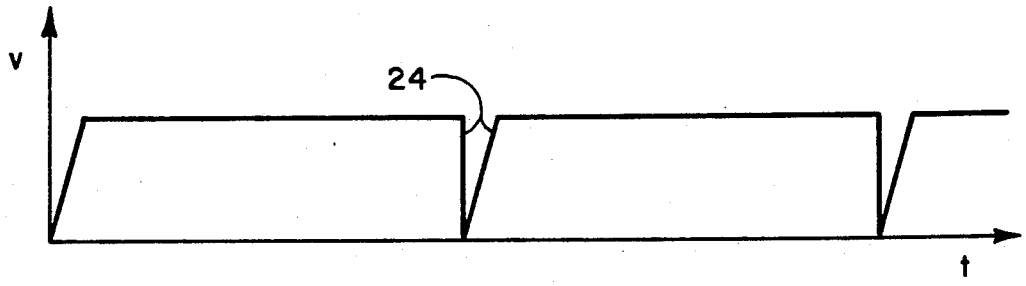
FIG. 4 is the time diagram of the variations of the speed of the piston of a reciprocating double-action pump according to the invention.

With respect to conventional decanting pumps actuated by connecting-rod/crank systems, the solution according to the present invention offers the advantage of providing a number of cycles which is normally between 30–35 per minute as opposed to a number of cycles equal to 70–75 per minute normally adopted in known decanting pumps. In conventional piston and double-action pumps, the variation of the piston's speed over time, as illustrated by the diagram of FIG. 3, furthermore entails pulsating flow which can vary from zero to a maximum value and back to zero, between which there are extensive regions 23 with no flow rate which must be compensated for in order to attempt to even out the flow as much as possible. In the case of hydraulic cylinder actuation according to the invention, the variation of the piston's movement speed over time, as illustrated in FIG. 4, entails pumping actions with a substantially constant flow rate, with only small regions 24 to be compensated for.

Another advantage of the present invention is that it allows flow rate variations by varying only the stroke of the piston 2, rather than its speed, by moving the limit switches 18, 18*a*. A further feature of the invention is that the two mutually rigidly associated stems 4, 4*a* and the respective pistons 2 and 11 can be rotated about their common axis by having the cam 17 in contact with a rotating shaft 25 provided with axial grooves 26, such that when the shaft 25 rotates, the cam 17 and thus the stems 4, 4*a* and pistons 2, 11 are also rotated. With this arrangement, a slight rotation can be imparted to the stems 4, 4*a* and the pistons 2, 11 for every stroke of the pistons 2, 1. Such rotation of the pistons 2, 11 is effective to prevent the formation of longitudinal scores on the surface of the cylinder, thus uniformly distributing its wear.

The central hydraulic distribution unit can be further provided with a device which reverses the flow when the actuation fluid reaches a "preset" maximum operating pressure of the hydraulic pump. Another advantage of the present invention is that the pump and the associated hydraulic cylinder can be installed in different rooms which may even be distant from those in which the remaining parts of the machine, such as the hydraulic pump and the related control unit and motor, are installed. This fact allows the pump to be used below deck, in the case of tanker ships, or in rooms devoid of air, liquids, gases or vapors.

The pump according to the invention can finally be coupled to other identical ones to form multiple-cylinder pumping stations. It is obvious that all modifications and variations with structurally and functionally equivalent characteristics which are within the inventive concept defined by the accompanying claims are within the scope of the present invention.

I claim:

1. An apparatus for use in pumping alimentary liquids, comprising:

a first cylinder adapted to be connected in a liquid network for the alimentary liquids;

a first piston mounted for reciprocable movement in said first cylinder;

a first piston stem fixed to said first piston;

drive means, coupled to said first piston stem, for forcing said first piston to reciprocate in said first cylinder;

rotation means, coupled to said first piston stem, for rotating said first piston stem and said first piston relative to said first cylinder;

valve means operatively connected to said first cylinder for controlling flow of the alimentary liquids to and from said first cylinder;

wherein said valve means comprises at least one ball valve, said at least one ball valve comprising a ball formed of rubber surrounding a hard inner core, and a ball seat formed of rubber surrounding a hard inner core;

wherein said drive means comprises a second cylinder, a second piston mounted for reciprocable movement in said second cylinder, and a second piston stem fixed to said second piston and to said first piston stem, and hydraulic control means for alternatingly feeding hydraulic fluid into said second cylinder on opposite sides of said second piston so as to force said second piston to reciprocate in said second cylinder;

wherein first and second position sensors are provided and are operatively connected to said hydraulic control means;

wherein means are provided for actuating said first position sensor when said first piston reaches a first position in said first cylinder, and for actuating said second position sensor when said first piston reaches a second position in said first cylinder;

wherein said first and second position sensors comprise first and second limit switches, respectively;

wherein said actuating means comprises an element fixedly mounted to at least one of said first and second piston stems such that when said first piston reaches said first position, said element contacts said first limit switch and, when said first piston reaches said second position, said element contacts said second limit switch; and wherein said rotation means comprises a rotatable shaft mounted in contact with said element and adapted to rotate said element.

2. An apparatus for use in pumping alimentary liquids, comprising:

a first cylinder adapted to be connected in a liquid network for the alimentary liquids;

a first piston mounted for reciprocal movement in said first cylinder;

a first piston stem fixed to said first piston;

drive means, coupled to said first piston stem, for forcing said first piston to reciprocate in said first cylinder;

rotation means, coupled to said first piston stem, for rotating said first piston stem and said first piston relative to said first cylinder;

first and second position sensors operatively connected to said hydraulic control means;

means for actuating said first position sensor when said first piston reaches a first position in said first cylinder, and for actuating said second position sensor when said first piston reaches a second position in said first cylinder;

wherein said first and second position sensors comprise first and second limit switches, respectively;

wherein said actuating means comprises an element mounted to said first piston stem such that when said first piston reaches said first position, said element contacts said first limit switch and, when said first piston reaches said second position, said element contacts said second limit switch; and wherein said rotation means comprises a rotatable shaft mounted in contact with said element and adapted to rotate said element.

3. An apparatus for use in pumping alimentary liquids, comprising:

a first cylinder adapted to be connected in a liquid network for the alimentary liquids;

a first piston mounted for reciprocable movement in said first cylinder;

a first piston stem fixed to said first piston;

drive means, coupled to said first piston stem, for forcing said first piston to reciprocate in said first cylinder;

rotation means, coupled to said first piston stem, for rotating said first piston stem and said first piston relative to said first cylinder;

an element fixed to said first piston stem for rotation therewith; and wherein said rotation means comprises a rotatable shaft mounted in contact with said element and adapted to rotate said element.

4. An apparatus as recited in claim 3, further comprising valve means operatively connected to said first cylinder for controlling flow of the alimentary liquids to and from said first cylinder;

wherein said valve means comprises at least one ball valve, said at least one ball valve comprising a ball formed of rubber surrounding a hard inner core, and a ball seat formed of rubber surrounding a hard inner core.

5. An apparatus as recited in claim 12, wherein said at least one ball valve comprises a first ball valve for allowing liquid to flow into but not out of said first cylinder on a first side of said first piston, a second ball valve for allowing liquid to flow into but not out of said first cylinder on a second side of said first piston opposite said first side, a third ball valve for allowing liquid to flow out of but not into said first cylinder on said first side of said first piston, and a fourth ball valve for allowing liquid to flow out of but not into said first cylinder on said second side of said first piston.

6. An apparatus as recited in claim 4, wherein said drive means comprises a second cylinder, a second piston mounted for reciprocable movement in said second cylinder, and a second piston stem fixed to said second piston and to said first piston stem.

7. An apparatus as recited in claim 6, wherein said drive means further comprises hydraulic control means for alternatingly feeding hydraulic fluid into said second cylinder on opposite sides of said second piston, so as to force said second piston to reciprocate in said second cylinder.

8. An apparatus as recited in claim 7, further comprising first and second position sensors operatively connected to said hydraulic control means; and means for actuating said first position sensor when said first piston reaches a first position in said first cylinder, and for actuating said second position sensor when said first piston reaches a second position in said first cylinder.

* * * * *

UNITED STATES PATENT AND TRADEMARK OFFICE

CERTIFICATE OF CORRECTION

PATENT NO. : 5,110,267

DATED : May 5, 1992

INVENTOR(S) : Alberto GIORDANI

It is certified that error appears in the above-identified patent and that said Letters Patent is hereby corrected as shown below:

In column 1, line 20, for "comprised", read --compromised--.

Signed and Sealed this

Twelfth Day of October, 1993

*Attest:*

*Attesting Officer*

BRUCE LEHMAN

*Commissioner of Patents and Trademarks*